US011624263B2

(12) United States Patent
Madan et al.

(10) Patent No.: US 11,624,263 B2
(45) Date of Patent: Apr. 11, 2023

(54) ENTERING A LATERAL WELLBORE IN A MULTI-LATERAL WELLBORE WITH A GUIDE TOOL

(71) Applicant: Saudi Arabian Oil Company, Dhahran (SA)

(72) Inventors: Mohammad A. Madan, Saihat (SA); Talal A. Shihabuddin, Dhahran (SA); Omar M. Alhamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/329,991

(22) Filed: May 25, 2021

(65) Prior Publication Data

US 2022/0381117 A1 Dec. 1, 2022

(51) Int. Cl.

| | |
|---|---|
| ***E21B 41/00*** | (2006.01) |
| ***E21B 47/09*** | (2012.01) |
| ***E21B 17/05*** | (2006.01) |

(52) U.S. Cl.
CPC ..... *E21B 41/0035* (2013.01); *E21B 17/05* (2013.01); *E21B 47/09* (2013.01)

(58) Field of Classification Search
CPC ..... E21B 41/0035; E21B 47/09
See application file for complete search history.

(56) References Cited

U.S. PATENT DOCUMENTS

| | | | | |
|---|---|---|---|---|
| 6,378,627 | B1 | 4/2002 | Tubel et al. | |
| 6,843,317 | B2 | 1/2005 | Mackenzie | |
| 7,082,994 | B2 | 8/2006 | Frost, Jr. et al. | |
| 8,579,037 | B2 | 11/2013 | Jacob | |
| 2014/0138084 | A1* | 5/2014 | Al-Mulhem ..... | E21B 41/0035 166/50 |
| 2019/0301258 | A1 | 10/2019 | Li | |

FOREIGN PATENT DOCUMENTS

| | | |
|---|---|---|
| CA | 2762217 | 5/2015 |
| CA | 2802988 | 10/2015 |
| EP | 0792997 | 9/1997 |

* cited by examiner

*Primary Examiner* — Robert E Fuller
*Assistant Examiner* — Lamia Quaim
(74) *Attorney, Agent, or Firm* — Fish & Richardson P.C.

(57) ABSTRACT

A method and a lateral entry guide tool for deploying a work string in a wellbore defining a window and a lateral wellbore extending from the window are described. The work string and the tool are run through the wellbore to a distance above the window. A locator subassembly is activated to detect the window. The tool is run through the wellbore in a downhole direction from the distance above the window past the window. After the locator subassembly indicates that the tool is past the window, a window entry depth is determined based a depth at which the window was detected. The work string is pulled back to position the tool at the window entry depth. A positioning subassembly is activated. The work string is run through the window while adjusting and calibrating the positioning subassembly as the work string pass through the window into the lateral wellbore.

17 Claims, 8 Drawing Sheets

ENTERING A LATERAL WELLBORE IN A MULTI-LATERAL WELLBORE WITH A GUIDE TOOL

TECHNICAL FIELD

This disclosure relates to downhole operations performed in a multi-lateral wellbore.

BACKGROUND

Hydrocarbons are trapped in formations of the Earth. Wellbores are drilled by a drilling assembly through those formations. The wellbores conduct the hydrocarbons to the surface. A wellbore can include a main wellbore extending from a surface of the Earth downward into the formations of the Earth containing the water, oils, and hydrocarbons. The wellbore can include multiple lateral branches extending from the main wellbore.

SUMMARY

This disclosure describes technologies related to entering a lateral wellbore in a multi-lateral wellbore with a guide tool.

Formations of the Earth are filled with both liquid and gaseous phases of various fluids and chemicals including water, oils, and hydrocarbon gases. Wellbores are drilled in the formations of the Earth to form an oil and gas well. The wellbore conducts the water, oils, and hydrocarbon gases to a surface of the Earth. Operations such as drilling, logging, or workover are performed in the wellbore with a work string. A work string may not be able to enter the lateral wellbore from the main wellbore through the window or another lateral may be inadvertently entered. The work string includes a lateral entry guide tool to reposition the work string to enter the lateral wellbore from a main wellbore through the window.

The work string and the lateral entry guide tool are run through the wellbore to a distance above the window. The window is in a predetermined interval of the main wellbore. The lateral entry guide tool has a locator subassembly to detect the window. When the lateral entry guide tool is at the distance above the window, the locator subassembly is activated to detect the window. The lateral entry guide tool is then run the through the main wellbore in a downhole direction from the distance above the window past the window. After the locator subassembly detects the window and indicates that the lateral entry guide tool is past the window, a window entry depth is determined based a depth at which the window was detected by the locator subassembly.

The work string is pulled back to position the lateral entry guide tool at the window entry depth. A positioning subassembly of the lateral entry guide tool is activated. The work string is run through the window while simultaneously calibrating and adjusting the positioning subassembly as the work string pass through the window into the lateral wellbore.

Implementations of the present disclosure include a method of deploying a work string in a wellbore system including a main wellbore defining a window and a lateral wellbore extending from the window. The method includes running a work string including a lateral entry guide tool through the wellbore system to a distance above the window. In some implementations, the work string is a drill string.

The method includes activating a locator subassembly of the lateral entry guide tool. The locator subassembly detects the window. The locator subassembly can include at least one of an acoustic sensor, an electromagnetic sensor, or an infrared sensor.

The method includes running the lateral entry guide tool through the main wellbore in a downhole direction from the distance above the window past the window.

The method includes, after the locator subassembly indicates that the lateral entry guide tool is past the window, determining a window entry depth based a depth at which the window was detected by the locator subassembly. In some implementations, determining the window entry depth includes collecting a depth of a top edge of the window and a depth of a bottom edge of the window using the locator subassembly. In some implementations, determining the window entry depth includes comparing the depth of the top edge of the window and the depth of the bottom edge of the window.

The method includes pulling the work string back to position the lateral entry guide tool at the window entry depth. The method includes activating a positioning subassembly of the lateral entry guide tool after pulling the work string back.

The method includes simultaneously, running the work string through the window while calibrating and adjusting the positioning subassembly as the work string pass through the window into the lateral wellbore. In some implementations, calibrating the positioning subassembly to position the work string to enter the window include collecting a distance from the tool to a top edge of the window, a distance from the tool to the bottom edge of the window, a distance from the tool to an inner surface of the main wellbore, and a distance from the tool to an inner surface of the lateral wellbore using the locator subassembly. Calibrating the positioning subassembly can include transmitting the distance from the tool to the top edge of the window, the distance from the tool to the bottom edge of the window, the distance from the tool to the inner surface of the main wellbore, and the distance from the tool to the inner surface of the lateral wellbore from the locator subassembly to a controller of the lateral entry guide tool. Calibrating the positioning subassembly can include generating an angle between a longitudinal axis of the lateral entry guide tool and the inner surface of the main wellbore and a direction of the longitudinal axis of the tool with the distance from the tool to the top edge of the window, the distance from the tool to the bottom edge of the window, the distance from the tool to the inner surface of the main wellbore, the distance from the tool to the inner surface of the lateral wellbore, and a pre-programmed tool assembly characteristic using the controller.

In some implementations, calibrating the positioning subassembly to position the work string to enter the window includes operating a gear movement assembly of the positioning subassembly. The gear movement assembly extends and retracts to adjust the angle between the longitudinal axis of the lateral entry guide tool and the inner surface of the main wellbore. The gear movement assembly rotates a rotatable housing of the positioning subassembly. The rotatable housing adjusts the direction of the longitudinal axis of the lateral entry guide tool. Adjusting the angle and the direction of the lateral entry guide tool positions the lateral entry guide tool to avoid colliding with the inner surface of the main wellbore and to enter the lateral wellbore from the main wellbore through the window.

In some implementations, running the work string through the window while calibrating and adjusting the positioning subassembly as the work string pass through the window into the lateral wellbore includes energizing a first motor and a second motor of the gear movement assembly to move a first gear and a second gear, respectively, along a rack from a respective first position to a respective second position. The movement of the first gear and the second gear along the rack from a respective first position to a respective second position extends a first arm and a second arm laterally from other portions of the positioning subassembly. In some implementations, the first end of the first arm and the first end of the second arm are pivotably coupled by a pivot joint and a second end of the first arm and a second end of the second arm are pivotably coupled to the first gear and the second gear, respectively.

In some implementations, the method further includes deactivating the positioning subassembly after the lateral entry guide tool passes through the window into the lateral wellbore.

In some implementations, if the locator subassembly detects that the lateral entry guide tool is passing a bottom edge of the window while the positioning subassembly is activated, determining the lateral entry guide tool missed the window and remains in the main wellbore includes pulling the work string back to position the lateral entry guide tool at the window entry depth and running the work string through the window while calibrating and adjusting the positioning subassembly as the work string passes through the window into the lateral wellbore.

Further implementations of the present disclosure include a lateral entry guide tool for guiding a work string from a main wellbore through a window defined by the main wellbore into and a lateral wellbore extending from the window. The lateral entry guide tool includes an uphole and a downhole connector to couple to other components of a work string.

The lateral entry guide tool includes a positioning subassembly with extendable arms to position the work string to enter the lateral wellbore through the window. In some implementations, the positioning subassembly further includes a gear movement assembly coupled to the extendable arms to actuate the extendable arms between a retracted position and an extended position. In some implementations, actuating the extendable arms between the retracted position and the extended position adjusts an angle between a longitudinal axis of the tool and an inner surface of the main wellbore. In some implementations, the positioning subassembly includes a rotatable housing to adjust a direction of a longitudinal axis of the tool to avoid colliding with an inner surface of the main wellbore and to enter the lateral wellbore from the main wellbore through the window.

The lateral entry guide tool includes a locator subassembly attached to the positioning subassembly. The locator subassembly includes a sensor operable to detect the window. In some implementations, the sensor is further operable to detect a top edge of the window, a bottom edge of the window, a distance to an inner surface of the main wellbore, and a distance to an inner surface of the lateral wellbore. In some implementations, the sensor includes at least one of an ultrasonic sensor, a magnetic field sensor, or an infrared sensor.

The lateral entry guide tool includes a transmitter operable to send a signal indicating a presence of the window. In some implementations, the transmitter is further operable to send a signal representing the top edge of the window, a signal representing the bottom edge of the window, a signal representing distance to the inner surface of the main wellbore, and a signal representing the distance to the inner surface of the lateral wellbore.

The lateral entry guide tool includes a controller operatively coupled to the positioning subassembly and the locator subassembly. The controller includes a receiver in electronic communication with the locator subassembly and a processor operable to generate, with the value of a depth of the window and a tool characteristic, a command signal to actuate the positioning subassembly.

In some implementations, the controller receives the signal representing the value of the depth of the top edge of the window, the signal representing the value of the depth of the bottom edge of the window, the signal representing the value of the distance to the inner surface of the main wellbore, and the signal representing the value of the distance to the inner surface of the lateral wellbore from the locator subassembly. The controller then calculates an angle between a longitudinal axis of the tool and the inner surface of the main wellbore and a direction of the longitudinal axis of the tool with the value of the distance to the top edge of the window, the value of the distance to the bottom edge of the window, the value of the distance to the inner surface of the main wellbore, the value of the distance to the inner surface of the lateral wellbore, and a pre-programmed lateral entry guide assembly characteristic. The controller then calibrates a gear movement assembly to extend and retract to adjust the angle between the longitudinal axis of the tool and the inner surface of the main wellbore and a rotatable housing to adjust the direction of the longitudinal axis of the tool.

In some implementations, the gear movement assembly includes a first arm; a pivot joint coupled to a first end of the first arm; a second arm, a first end of the second arm coupled to the pivot joint; a first gear and a second gear, each gear pivotably coupled to a second end of the first arm and a second end of the first arm, respectively. In some implementations, the gear movement assembly includes a geared rail positioned inside the tool with the first gear and the second gear movably coupled to the geared rail. In some implementations, the gear movement assembly includes a first motor and a second motor operatively coupled to the first gear and the second gear, respectively. The first motor and the second motor move the first gear and the second gear along the geared rail to extend and retract the first arm and the second arm by the pivot joint. In some implementations, the controller further operates the first motor and the second motor to move the first gear and the second gear along the geared rail to extend and retract the first arm and the second arm by the pivot joint.

In some implementations, the gear movement assembly is a first gear movement assembly and the tool further includes a second gear movement assembly. The first gear movement assembly and the second gear movement assembly each can be positioned on an outer surface of the lateral entry guide tool on opposite sides of the lateral entry guide tool.

Implementations of the present disclosure can realize one or more of the following advantages. Environmental safety and personnel safety can be improved. For example, during a well intervention operation, the work string can smoothly, accurately, and quickly enter the desired lateral wellbore from the main wellbore through the window. Occurrences of entering an incorrect lateral wellbore can be reduced. For example, in the main wellbore, each window to a respective lateral wellbore is located in a separate depth interval according to the well plan. The lateral entry guide tool is programmed to enter the lateral wellbore in a predetermined interval, thus reducing the occurrences of entering the incorrect lateral wellbore. Lateral entry accuracy can be increased. For example, continually calibrating and adjusting the position subassembly to enter the lateral wellbore through the window can reduce collisions with the inner surface of the main wellbore, an edge of the window, or an inner surface of the lateral wellbore.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
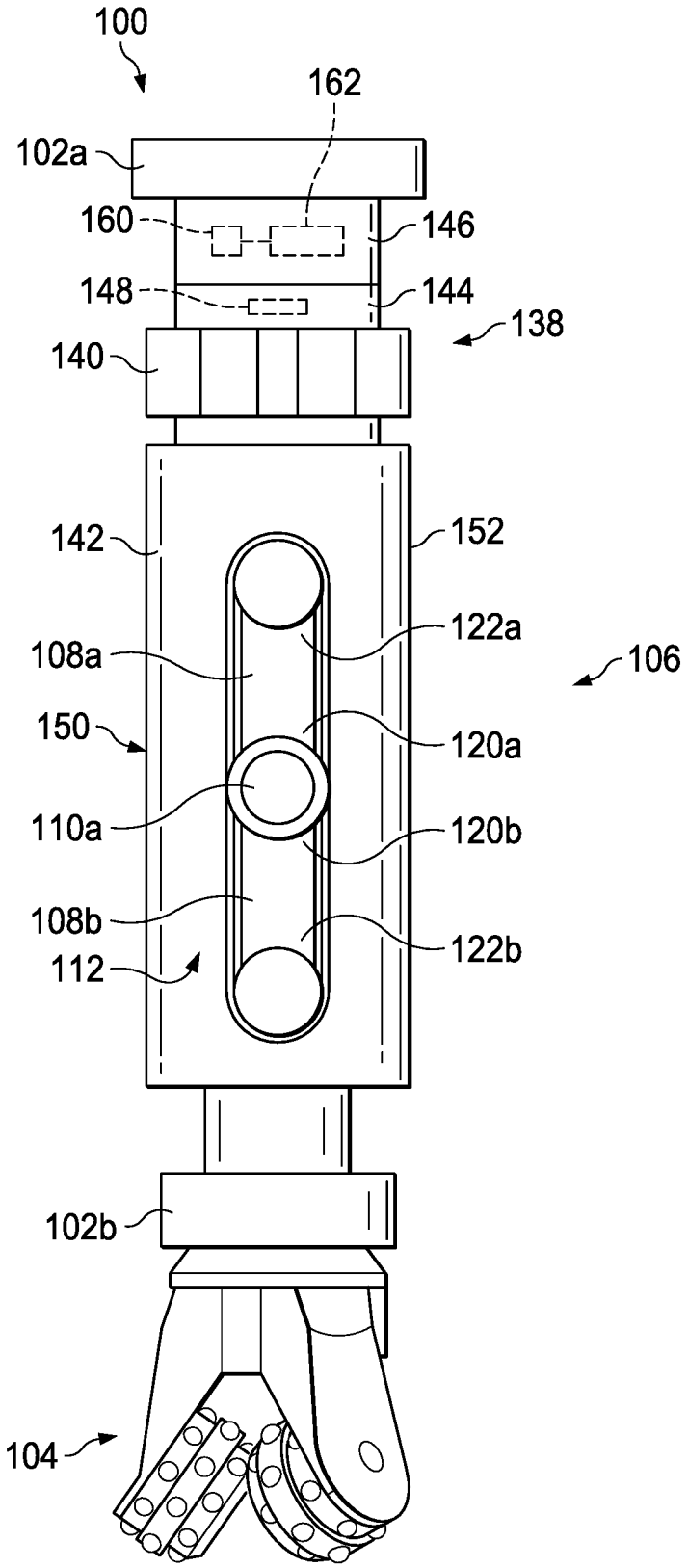
FIG. 1A is a schematic front view of a lateral entry guide tool.

The present disclosure relates to a method and a tool for entering a lateral wellbore in a multi-lateral wellbore with a lateral entry guide tool. Formations of the Earth are filled with both liquid and gaseous phases of various fluids and chemicals including water, oils, and hydrocarbon gases. Wellbores are drilled in the formations of the Earth to form an oil and gas well. The wellbore conducts the water, oils, and hydrocarbon gases to a surface of the Earth. Operations such as drilling, logging, or workover are performed in the wellbore with a work string. A work string may not be able to enter a lateral wellbore from a main wellbore through a window or another lateral may be inadvertently entered. The work string includes a lateral entry guide tool. The lateral entry guide tool repositions the work string to enter the lateral wellbore from the main wellbore through the window.

The work string and the lateral entry guide tool are run through the wellbore to a distance above the window. The window is in a predetermined interval of the main wellbore. The lateral entry guide tool has a locator subassembly to detect the window. When the lateral entry guide tool is at the distance above the window, the locator subassembly is activated to detect the window. The lateral entry guide tool is then run the through the main wellbore in a downhole direction from the distance above the window past the window. After the locator subassembly detects the window and indicates that the lateral entry guide tool is past the window, a window entry depth is determined based a depth at which the window was detected by the locator subassembly.

The work string is pulled back to position the lateral entry guide tool at the window entry depth. A positioning subassembly of the lateral entry guide tool is activated. The work string is run through the window while simultaneously calibrating and adjusting the positioning subassembly as the work string pass through the window into the lateral wellbore.

The lateral entry guide tool guides the working string from the main wellbore through the window and into the lateral wellbore extending from the window. The lateral entry guide tool has an uphole and a downhole connector to couple to other components of the work string. The lateral entry guide tool has a positioning subassembly with extendable arms to position the work string to enter the lateral wellbore through the window.

The lateral entry guide tool has a locator subassembly attached to the positioning subassembly. The locator subassembly has a sensor that operates to detect the window. The locator subassembly also has a transmitter to send a signal indicating a presence of the window.

The lateral entry guide tool has a controller operatively coupled to the positioning subassembly and the locator subassembly. The controller has a receiver in electronic communication with the locator subassembly. The controller also has a processor to generate a command signal to actuate the positioning subassembly based on the value of a depth of the window and a tool characteristic.

Figure 2A:
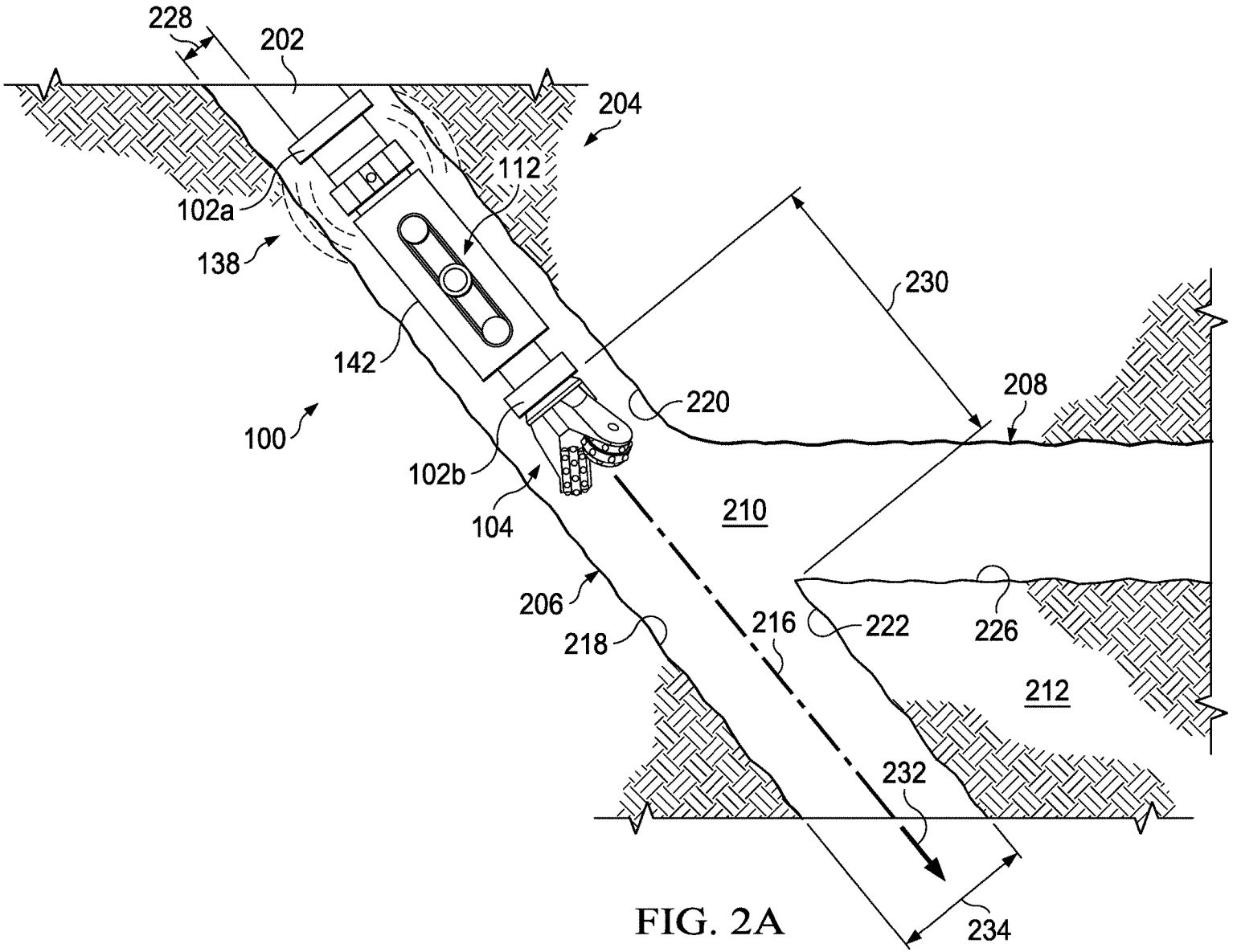
FIG. 2A is a schematic view of the lateral entry guide tool of FIG. 1A positioned uphole of the window to the lateral wellbore.

FIG. 1A is a schematic front view of a lateral entry guide tool 100. FIG. 2A is a schematic view of the lateral entry guide tool of FIG. 1A positioned uphole of the window to the lateral wellbore. Referring to FIG. 2A, the lateral entry guide tool 100 guides a work string 202 through a wellbore system 204. The wellbore system 204 includes a main wellbore 206 and a lateral wellbore 208 connected to the main wellbore 206 by a window 210. The window 210 can be referred to as an opening. The lateral entry guide tool 100 guides the work string 202 through the main wellbore 206 and into the lateral wellbore 208 through the window 210.

The work string 202 can include a downhole conveyor such as a drill pipe, a coiled tubing assembly, or a production tubular. The work string 202 can include a logging tool to perform a logging operation on the wellbore system or a subterranean formation 212 surrounding the wellbore system or a workover tool to perform a workover operation in the wellbore.

As shown in FIG. 1A, the lateral entry guide tool 100 includes an uphole connector 102*a* and a downhole connector 102*b*. The uphole and downhole connectors 102*a*, 102*b* mechanically couple the lateral entry guide tool 100 to other components of the work string 202. For example, as shown in FIGS. 1A and 2A, the downhole connector 102*b* connects the lateral entry guide tool 100 to a downhole tool 104. The downhole tool 104 can be, as shown in FIGS. 1A and 2A, a drill bit for drilling another lateral wellbore from the lateral wellbore 208 or cleaning out the lateral wellbore 208.

Referring to FIG. 2A, the uphole connector 102*a* connects the lateral entry guide tool 100 to the work string 202. The work string 202 can include a bottom hole assembly to perform various operations in the main wellbore 206 or the lateral wellbore 208. For example, the bottom hole assembly can perform a drilling operation with a drill bit, a plug and abandon operation, a wellbore cleanout run, a logging operation, or a packer setting operation.

The uphole and downhole connectors 102*a*, 102*b* can be standard API (American Petroleum Institute) rotary shouldered pin connectors. The standard API rotary shouldered connectors include a regular connection, a numeric connection, an internal flush connection, or a full hole connection. The pin connection can be a manufacturer proprietary design. The connectors 102*a*, 102*b* can be a box connection, where the threads are internal to the box. The connectors 102*a*, 102*b* can have an outer diameter corresponding to a standard American Petroleum Institute connection size. For example, the uphole and downhole connectors 102*a*, 102*b* can have an outer diameter 130 of 4½ inches, 5½ inches, 6⅝ inches, 7 inches, 7⅝ inches, 8⅝ inches, 9⅝ inches, 10¾ inches, 11¾ inches, or 13⅜ inches.

The lateral entry guide tool 100 includes a positioning subassembly 106. The positioning subassembly 106 includes a first extendable arm 108*a* and a second extendable arm 108*b*. The extendable arms 108*a*, 108*b* are coupled to each other by a first pivot joint 110*a* at respective first ends 120*a*, 120*b* of each extendable arm 108*a*, 108*b*. The extendable arms 108*a*, 108*b* each have a second end 122*a*, 122*b*, respectively. The extendable arms 108*a*, 108*b* extend and retract from the positioning subassembly 106 to position the lateral entry guide tool 100, the work string 202, and the downhole tool 104 mechanically coupled to the lateral entry guide tool 100 to enter the lateral wellbore 208 through the window 210. The extendable arms 108*a*, 108*b*, by the first pivot joint 110*a*, contact the main wellbore 206 to move the lateral entry guide tool 100. The first extendable arm 108*a*, the second extendable arm 108*b*, and the first pivot joint 110*a* can be referred to as an extendable arm set, an arm set, or a set of arms.

Figure 1B:
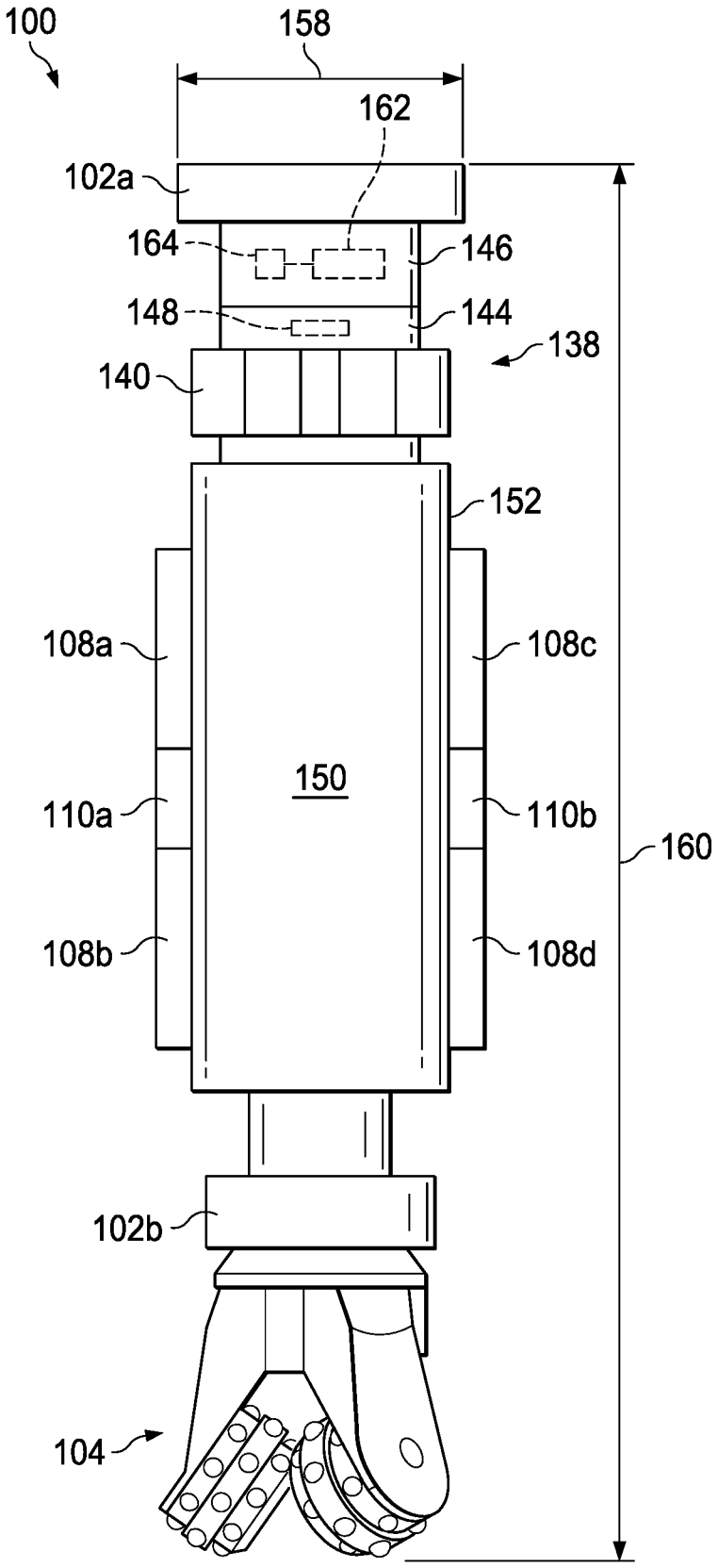
FIG. 1B is a schematic side view of the lateral entry guide tool of FIG. 1A.

FIG. 1B is a schematic side view of the lateral entry guide tool 100 of FIG. 1A. Referring to FIG. 1B, the lateral entry guide tool 100 includes a third extendable arm 108*c* and a fourth extendable arm 108*d* coupled to each other by a second pivot joint 110*b*, substantially similar to the extendable arms and pivot joint previously described. The third and fourth extendable arms 108*c*, 108*d* are positioned opposite the first and second extendable arms 108*a*, 108*b*. The third extendable arm 108*c*, the fourth extendable arm 108*d*, and the second pivot joint 110*b* can be referred to as a second extendable arm set, a second arm set, or a second set of arms.

The positioning subassembly 106 can include additional sets of arms. For example, the positioning subassembly can include a third set of arms. When the positioning assembly includes a third set of arms, each set of arms can be arranged about the positioning assembly, for example, with 120° between each set of arms.

Figure 1C:
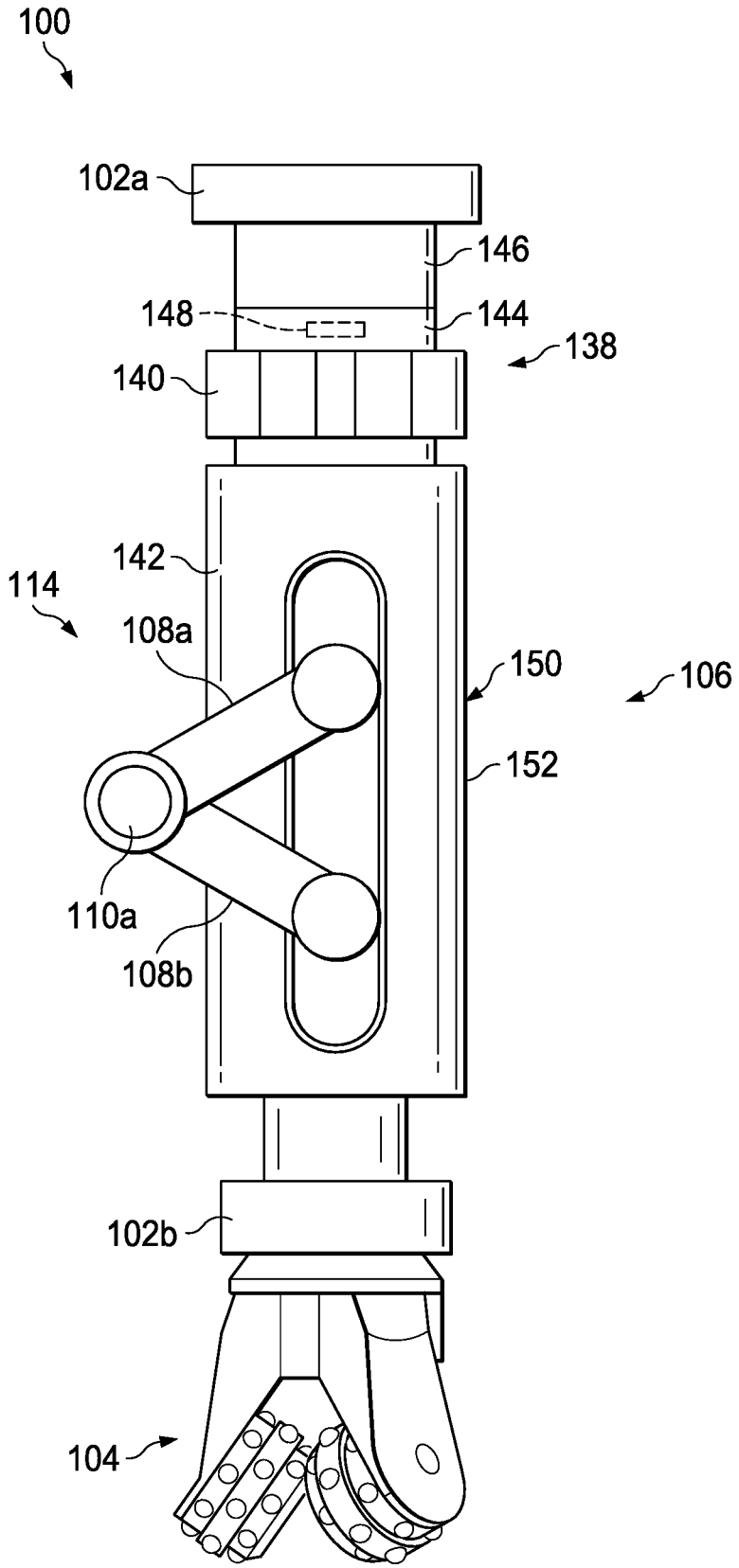
FIG. 1C is a schematic side view of the lateral entry guide tool of FIG. 1B with the extendable arms extended.

FIGS. 1A-1B and 2A show the extendable arms 108*a*, 108*b* in a retracted position 112. FIG. 1C is a schematic view of the lateral entry guide tool 100 of FIG. 1B with the extendable arms 108*a*, 108*b* extended. Referring to FIG. 1C, the extendable arms 108*a*, 108*b* are extended radially to an extended position 114.

Figure 2B:
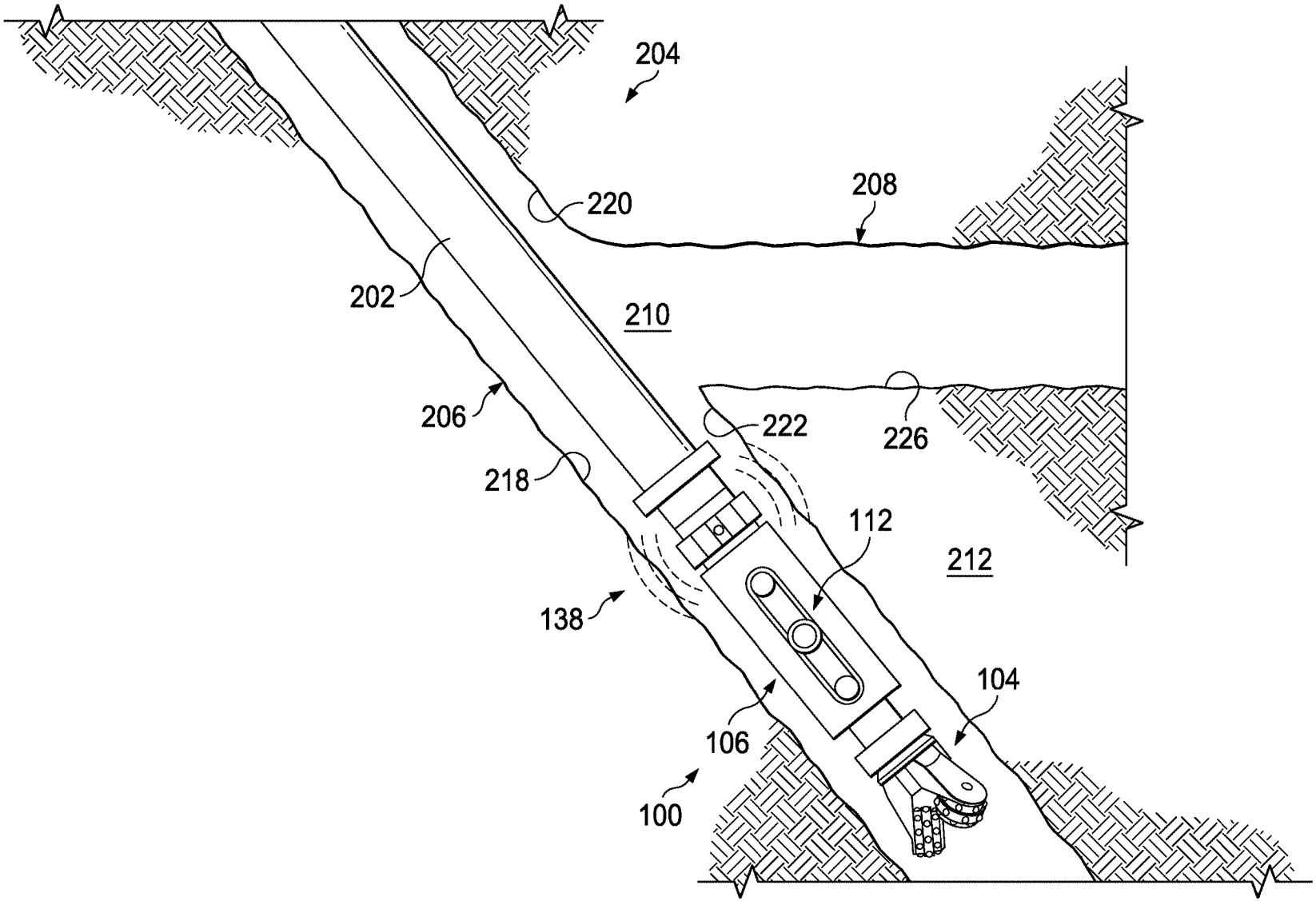
FIG. 2B is a schematic view of the lateral entry guide tool of FIG. 1A positioned downhole of the lateral wellbore.
Figure 2C:
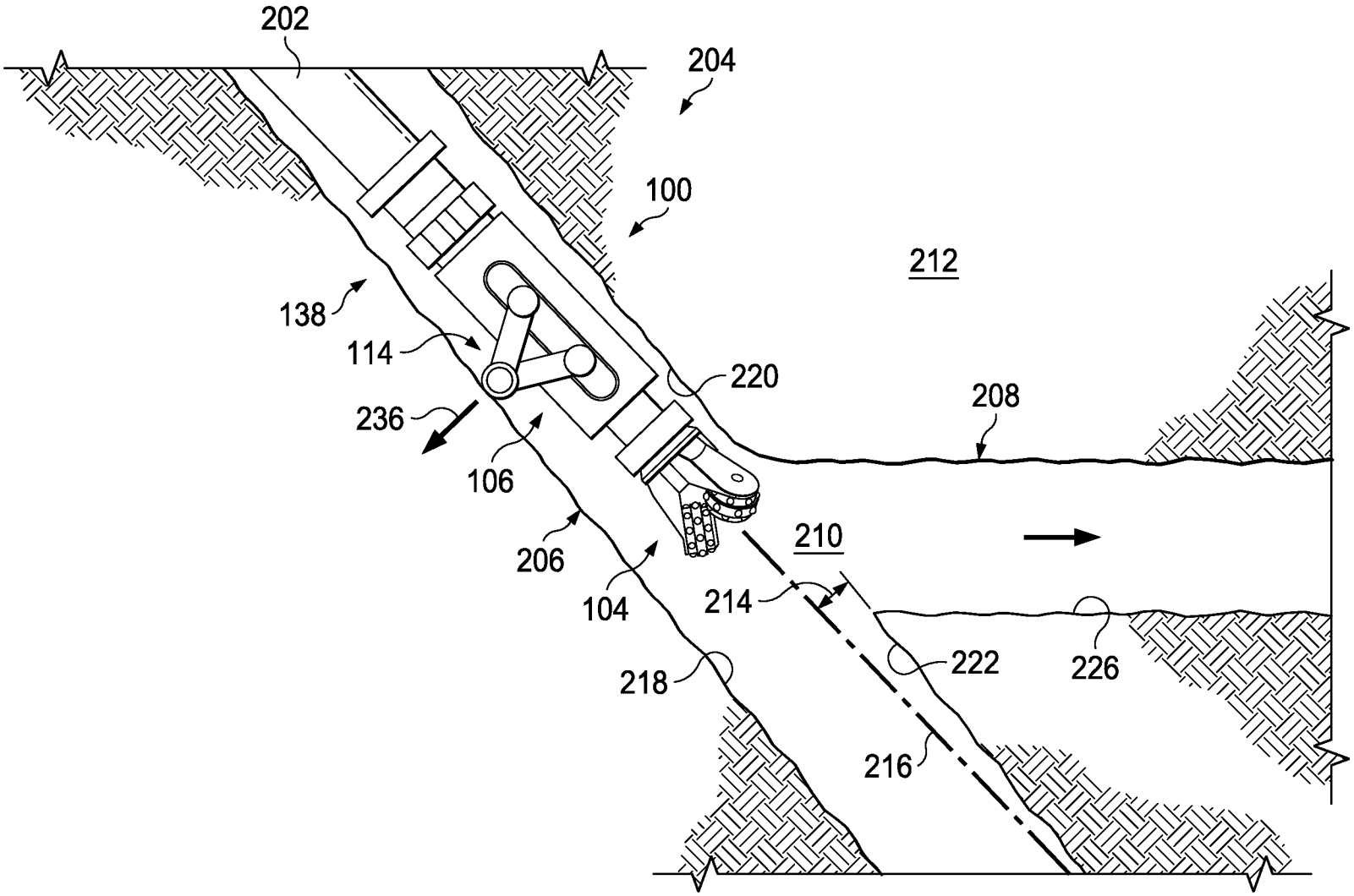
FIG. 2C is a schematic view of the lateral entry guide tool of FIG. 2A positioned to enter the lateral wellbore.

FIG. 2C is a schematic view of the lateral entry guide tool 100 of FIG. 2A positioned to enter the lateral wellbore 208. Referring to FIGS. 1A-1C, 2A, and 2C, actuating the extendable arms 108*a*, 108*b* between the retracted position 112 and the extended position 114 adjusts an angle 214 between a longitudinal axis 216 of the lateral entry guide tool 100 and an inner surface 218 of the main wellbore 206.

Figure 1D:
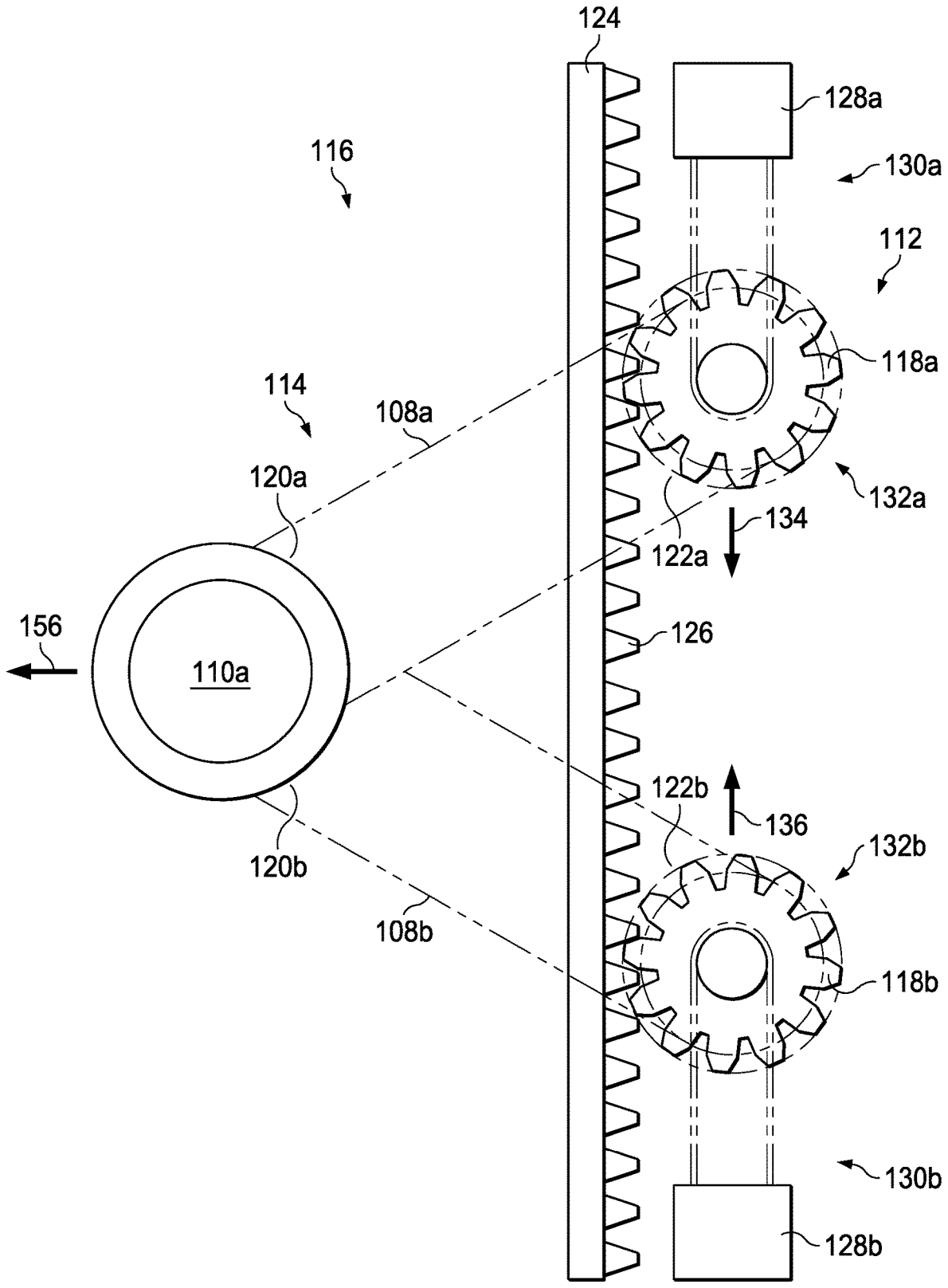
FIG. 1D is a schematic view of a gear movement mechanism of the lateral entry guide tool of FIG. 1A with the extendable arms extended.

FIG. 1D is a schematic view of a gear movement mechanism of the lateral entry guide tool 100 of FIG. 1A with the extendable arms 108*a*, 108*b* extended in the direction of arrow 156. Referring to FIGS. 1A, 1C, 1D, 2A, and 2C, the positioning subassembly 106 includes a gear movement assembly 116 (shown in FIG. 1D). The gear movement assembly 116 is operably coupled to the extendable arms 108*a*, 108*b*. The gear movement assembly 116 actuates the extendable arms 108*a*, 108*b* between the retracted position 112 and an extended position 114.

As shown in FIG. 1D, the gear movement assembly 116 includes a first gear 118*a*. The first gear 118*a* is pivotably coupled to the second end 122*a* of the first extendable arm 108*a*. In FIG. 1D, the first extendable arm 108*a* is transparent with dashed lines. The gear movement assembly 116 includes a second gear 118*b*. The second gear 118*b* is pivotably coupled to the second end 122*b* of the second extendable arm 108*b*. In FIG. 1D, the second extendable arm 108*b* is also transparent with dashed lines. The first end 120*a* of the first extendable arm 108*a* is coupled to the first end 120*b* of the second extendable arm 108*b* by the first pivot joint 110*a*.

The gear movement assembly 116 includes a geared rail 124. The geared rail 124 is positioned within the positioning subassembly 106. The geared rail 124 includes multiple gear teeth 126. The gear teeth 126 engage the gears 118*a* and 118*b*. The gears 118*a*, 118*b* move along the geared rail 124. Moving the gears 118*a*, 118*b* along the geared rail 124 actuates the extendable arms 108*a*, 108*b* between the retracted position 112 and the extended position 114. The gear movement assembly 116 can be referred to as a rack and pinion gear assembly.

The gear movement assembly 116 includes a first motor 128*a*. The first motor 128*a* can be referred to as an upper motor. The first motor 128*a* is operatively coupled to the first gear 118*a*. The first motor 128*a* moves the first gear 118*a* along the geared rail 124 from a first position 130*a* to a second position 132*a* in the direction of arrow 134. The first motor 128*a* moving the first gear 118*a* along the geared rail 124 from the first position 130*a* to the second position 132*a* in the direction of arrow 134 actuates the first extendable arm 108*a* from the retracted position 112 to the extended position 114. The first motor 128*a* moving the first gear 118*a* along the geared rail 124 from the second position 132*a* to the first position 130*a* in the direction of arrow 136 actuates the first extendable arm 108*a* from the extended position 114 to the retracted position 112.

The gear movement assembly 116 includes a second motor 128*b*. The second motor 128*b* can be referred to as a lower motor. The second motor 128*b* is operatively coupled to the second gear 118*b*. The second motor 128*b* moves the second gear 118*b* along the geared rail 124 from another first position 130*b* to another second position 132*b* in the direction of arrow 136. The second motor 128*b* moving the second gear 118*b* along the geared rail 124 from the other first position 130*b* to the other second position 132*b* in the direction of arrow 136 actuates the second extendable arm 108*b* from the retracted position 112 to the extended position 114. The second motor 128*b* moving the second gear 118*b* along the geared rail 124 from the other second position 132*b* to the other first position 130*b* in the direction of arrow 134 actuates the second extendable arm 108*b* from the extended position 114 to the retracted position 112.

The first motor 128*a* and the second motor 128*b* simultaneously operate the first gear 118*a* and the second gear 118*b*, respectively. For example, the first motor 128*a* and the second motor 128*b* can simultaneously move the first gear 118*a* and the second gear 118*b* at the same speed. For example, the first motor 128*a* and the second motor 128*b* simultaneously move the first gear 118*a* and the second gear 118*b* from the respective first positions 130*a*, 130*b* to the respective second positions 132*a*, 132*b* over an equal distance along the geared rail 124.

In some cases, the gear movement assembly 116 additionally operates the third and fourth extendable arms 108*c* and 108*d*. In other cases, the positioning subassembly 106 includes a second gear movement assembly, not shown, substantially similar to the gear movement assembly previously described. In such a case, the second gear movement assembly is operatively coupled to the third and fourth extendable arms 108*c*, 108*d* as previously described in reference to the gear movement assembly 116 and the extendable arms 108*a*, 108*b*.

Referring to FIG. 1A, the lateral entry guide tool 100 includes a rotatable housing 150. The rotatable housing 150 includes an outer sleeve 152. The rotatable housing 150 includes an inner bearing assembly 154. Referring to FIGS. 1A and 2A, the rotatable housing 150 adjusts a direction 232 of the longitudinal axis 216 of the lateral entry guide tool 100. Adjusting the direction 232 of the longitudinal axis 216 can decrease the occurrences of the lateral entry guide tool 100 colliding with the inner surface 218 of the main wellbore 206 and to enter the lateral wellbore 208 from the main wellbore 206 through the window 210.

Referring to FIG. 1A, the lateral entry guide tool 100 includes a locator subassembly 138. The locator subassembly is attached to the positioning subassembly 106 and the first connector 102*a*. The locator subassembly 138 is a data collection and reading tool and sends the data to a controller 146 (described later) which has pre-set algorithms to calculate where the extendable arms 108*a*, 108*b* should extend and push on an inner surface 224 of the main wellbore 206 to guide the lateral entry guide tool 100 into the lateral wellbore 208.

The locator subassembly 138 includes a sensor 140. The sensor 140 is operable to detect the window 210. The sensor 140 can be an ultrasonic sensor, a magnetic field sensor, or an infrared sensor.

FIG. 2B is a schematic view of the lateral entry guide tool 100 of FIG. 1A after being run downhole past the lateral wellbore 208. Referring to FIGS. 1A-1B and 2A-2B, the sensor 140 can detect a top edge 220 of the window 210 and a bottom edge 222 of the window 210. Additionally, the sensor 140 can detect (measure) a distance 228 (shown in FIG. 2A) from the outer surface 142 (shown in FIGS. 1A and 2A) of the lateral entry guide tool 100 to the inner surface 224 (shown in FIG. 2A) of the main wellbore 206. The sensor 140 can also detect a distance 230 from the outer surface 142 (shown in FIGS. 1A and 2A) of the lateral entry guide tool 100 to an inner surface 226 of the lateral wellbore 208. The distance 230 can be calibrated (adjusted) based on the type of downhole tool 104 and the downhole tool's 104 characteristics such as length and diameter. The distance 230 can be calibrated based on a diameter 158 or a length 160 of the lateral entry guide tool 100. The distance 230 can be calibrated based on a diameter 234 of the main wellbore 206.

The locator subassembly 138 includes a transmitter 144. The transmitter 144 is mechanically and electrically coupled to the sensor 140. The transmitter 144 is in electronic communication with the sensor 140. The transmitter 144 receives signals representing the presence of the window 210, such as the top edge 220 of the window 210 and the bottom edge 222 of the window 210 from the sensor 140. The transmitter 144 also receives signals representing the distance 228 from the outer surface 142 (shown in FIGS. 1A and 2A) of the lateral entry guide tool 100 to the inner surface 224 (shown in FIG. 2A) of the main wellbore 206 that the lateral entry guide tool 100 is in.

The transmitter 144 sends the signals representing the presence of the window 210, such as the top edge 220 of the window 210 and the bottom edge 222 of the window 210. The transmitter 144 also sends the signals representing the distance 228 to from the outer surface 142 (shown in FIGS. 1A and 2A) of the lateral entry guide tool 100 to an inner surface 224 (shown in FIG. 2A) of the main wellbore 206.

The lateral entry guide tool 100 includes the controller 146. The controller 146 is operatively coupled to the positioning subassembly 106 and the locator subassembly 138. The controller 146 can include a processor 162, that is, a computer with a microprocessor. The controller 146 has one or more sets of programmed instructions stored in a memory or other non-transitory computer-readable media that stores data (e.g., connected with the printed circuit board), which can be accessed and processed by a microprocessor. The programmed instructions can include, for example, instructions for sending or receiving signals and commands to operate the positioning subassembly 106 and/or collect and store data from the sensor 140 of the locator subassembly 138. The controller 146 stores values (signals and commands) against which sensed values (signals and commands) representing the condition are compared. The processor 162 generates a command signal to actuate the positioning subassembly 106 based on the value of a depth of the window 210, a downhole tool characteristic, and/or a lateral entry guide tool characteristic.

The controller 146 includes a receiver 148. The receiver 148 is in electronic communication with the locator subassembly 138. The receiver 148 receives the signals representing the presence of the window 210, such as the top edge 220 of the window 210 and the bottom edge 222 of the window 210 from the transmitter 144. The transmitter 144 also sends the signals representing the distance 228 to from the outer surface 142 (shown in FIGS. 1A and 2A) of the lateral entry guide tool 100 to an inner surface 224 (shown in FIG. 2A) of the main wellbore 206 from the transmitter 144. Also, the transmitter 144 sends the signals representing the distance 230 from the outer surface 142 (shown in FIGS. 1A and 2A) of the lateral entry guide tool 100 to the inner surface 226 of the lateral wellbore 208 from the transmitter 144.

Referring to FIGS. 1A, 2A, and 2C, the controller 146 reads the data (the signals) that is collected from the sensor 140, and the controller 146 sends this data to a surface panel (another controller on the surface, not shown), and also the controller 146 will command the lateral entry guide tool 100 to operate. The controller 146 calculates, with the value of the top edge 220 of the window 210, the value of the bottom edge 22 of the window 210, the value of the distance 228 to the inner surface 218 of the main wellbore 206, the value of the distance 230 to the inner surface 226 of the lateral wellbore 208, and a pre-programmed lateral entry guide assembly characteristic (such as the length and the diameter), the angle 214 between the longitudinal axis 216 and the inner surface 218 of the main wellbore 206 (shown in FIG. 2C). The controller 146 also calculates the direction 232 of the longitudinal axis 216 (shown in FIG. 2A) based on the value of the top edge 220 of the window 210, the value of the bottom edge 222 of the window 210, the value of the distance 228 to the inner surface 218 of the main wellbore 206, the value of the distance 230 to the inner surface 226 of the lateral wellbore 208, and a pre-programmed lateral entry guide assembly characteristic (such as the length and the diameter).

Referring to FIGS. 1A, 1D, 2A, and 2C, the controller 146 calibrates the gear movement assembly 116. Calibrating the gear movement assembly 116 actuates the extendable arms 108*a* and 108*b* to extend and retract to adjust the angle 214 between the longitudinal axis 216 and the inner surface 218 of the main wellbore 206. Additionally, the controller 146 actuates the rotatable housing 150 to adjust the direction 232 of the longitudinal axis 216 of the lateral entry guide tool 100.

The lateral entry guide tool 100 includes a power source 164. The power source 164 is electrically coupled to and supplies electrical power to the controller 146, the locator subassembly 138, and the positioning subassembly 106. The power source 164 can be a battery positioned in the lateral entry guide tool 100. In some cases, the power source 164 can be positioned in the work string. For example, the power source 164 can be in the logging tool.

As shown in FIG. 2A, the work string 202 will be run into main wellbore 206, and while running, the locator subassembly 138 will identify the depth and angle of the top edge 220 of the window 210, and the work string 202 will keep running into main wellbore 206 until the locator subassembly 138 passes the lower edge of the window 210, as shown in FIG. 2B, and again identifies the depth and angle of the bottom edge 222. After that, as shown in FIG. 2C, the work string 202 will be pulled out above the top edge 220 of the window 210 and since the depths, distances, and angles have been identified, the lateral entry guide tool 100 will calibrate and provide the depth and distances at which the extendable arms 108*a*, 108*b* should extend radially and push against the inner surface 218 of the main wellbore 206 to guide the lateral entry guide tool 100 and the work string 202 through the window 210. As shown in FIG. 2C, the extendable arms 108*a*, 108*b* are pushing against the inner surface 218 of the main wellbore 206 in the direction of arrow 236 to guide the lateral entry guide tool 100 into the lateral wellbore 208. Historical data for depths and angles, can be pre-registered (loaded) into the controller 146 to confirm the actual depth values in order to calibrate the needed depth for the extendable arms 108*a*, 108*b* to extend radially and guide the lateral entry guide tool 100 and the work string 202 into the lateral wellbore 208.

Figure 3:
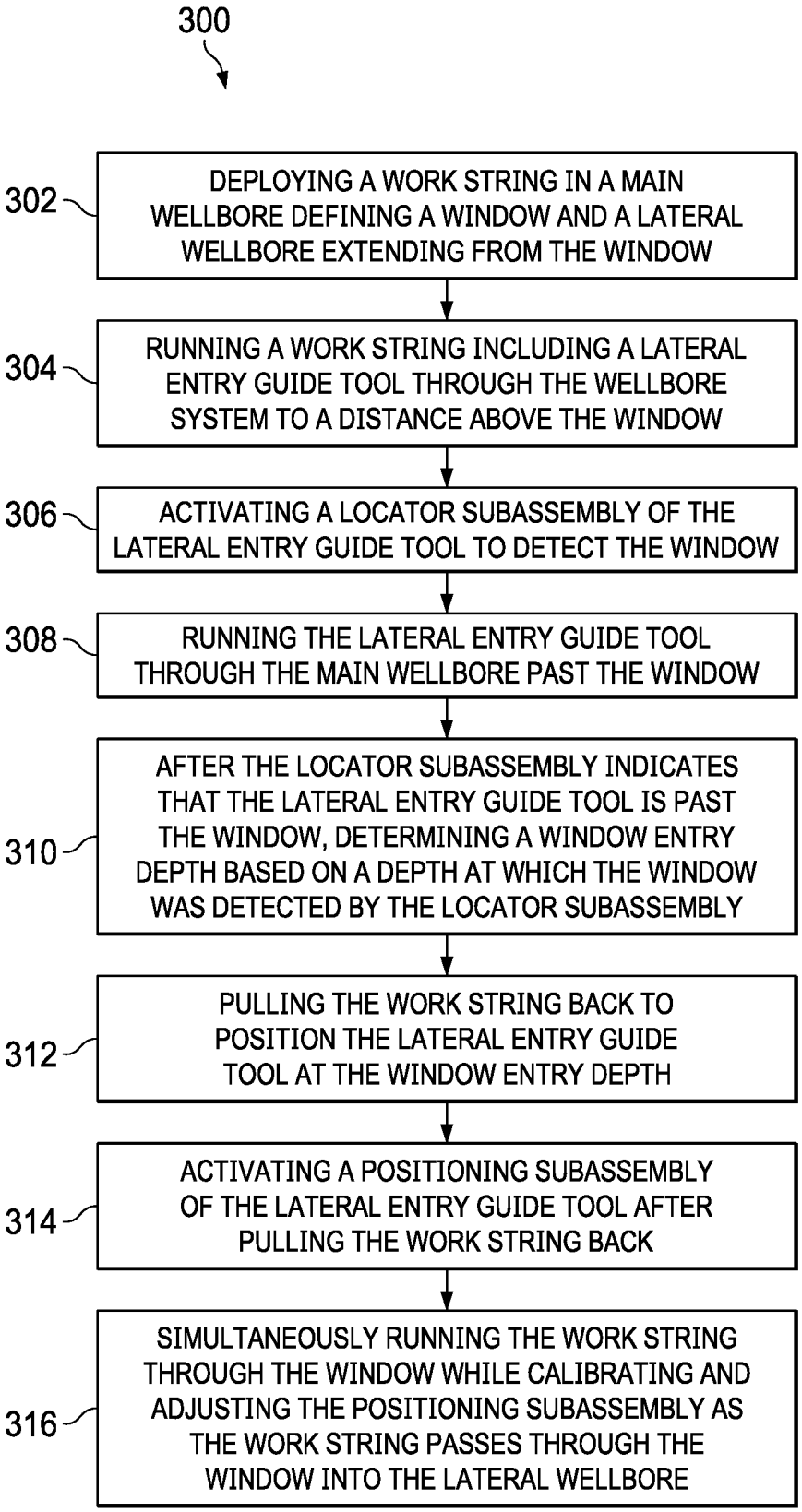
FIG. 3 is a flow chart of an example method of entering a lateral wellbore in a multi-lateral wellbore with a lateral entry guide tool according to the implementations of the present disclosure.

FIG. 3 is a flow chart of an example method 300 of entering a lateral wellbore from a main wellbore through a window with a lateral entry guide tool according to the implementations of the present disclosure. At 302, a work string is deployed in a wellbore system including a main wellbore defining a window and a lateral wellbore extending from the window. For example, the work string can be a drill string, a plug and abandon assembly, a wellbore cleanout assembly, a packer setting assembly, or a milling assembly.

At 304, the work string including the lateral entry guide tool is run through the wellbore system to a distance above the window. The window is in a predetermined interval of the main wellbore. At 306, a locator subassembly of the lateral entry guide tool is activated. The locator subassembly detects the window. The locator subassembly includes at least one of an acoustic sensor, an electromagnetic sensor, or an infrared sensor. At 308, the lateral entry guide tool is run through the main wellbore in a downhole direction from the distance above the window past the window.

At 310, after the locator subassembly indicates that the lateral entry guide tool is past the window, a window entry depth is determined. The window entry depth is based a depth at which the window was detected by the locator subassembly. Determining the window entry depth can include collecting a depth of a top edge of the window and a depth of a bottom edge of the window using the locator subassembly and comparing the depth of the top edge of the window and the depth of the bottom edge of the window.

At 312, the work string is pulled back to position the lateral entry guide tool at the window entry depth. At 314, after pulling the work string back, a positioning subassembly of the lateral entry guide tool is activated.

At 316, the work string is simultaneously run through the window while calibrating and adjusting the positioning subassembly as the work string passes through the window into the lateral wellbore. Calibrating the positioning subassembly to position the work string to enter the window can include collecting a distance from the tool to a top edge of the window, a distance from the tool to the bottom edge of the window, a distance from the tool to an inner surface of the main wellbore, and a distance from the tool to an inner surface of the lateral wellbore using the locator subassembly. Calibrating the positioning subassembly to position the work string to enter the window can include transmitting the distance from the tool to the top edge of the window, the distance from the tool to the bottom edge of the window, the distance from the tool to the inner surface of the main wellbore, and the distance from the tool to the inner surface of the lateral wellbore from the locator subassembly to a controller of the lateral entry guide tool. Calibrating the positioning subassembly to position the work string to enter the window can include generating, with the distance from the tool to the top edge of the window, the distance from the tool to the bottom edge of the window, the distance from the tool to the inner surface of the main wellbore, the distance from the tool to the inner surface of the lateral wellbore, and a pre-programmed tool assembly characteristic using the controller, an angle between a longitudinal axis of the lateral entry guide tool and the inner surface of the main wellbore and a direction of the longitudinal axis of the tool.

Calibrating the positioning subassembly to position the work string to enter the window can include operating a gear movement assembly of the positioning subassembly. The gear movement assembly extends radially and retracts to adjust the angle between the longitudinal axis of the lateral entry guide tool and the inner surface of the main wellbore. Calibrating the positioning subassembly to position the work string to enter the window can include rotating a rotatable housing of the positioning subassembly. The rotatable housing adjusts the direction of the longitudinal axis of the lateral entry guide tool. Adjusting the angle and the direction of the lateral entry guide tool positions the lateral entry guide tool to avoid colliding with the inner surface of the main wellbore and to enter the lateral wellbore from the main wellbore through the window.

Running the work string through the window while calibrating and adjusting the positioning subassembly as the work string pass through the window into the lateral wellbore can include energizing a first motor and a second motor of the gear movement assembly to move a first gear and a second gear, respectively, along a rack from a respective first position to a respective second position. Movement of the first gear and the second gear along the rack from a respective first position to a respective second position extends a first arm and a second arm laterally from other portions of the positioning subassembly. The first end of the first arm and the first end of the second arm can be pivotably coupled by a pivot joint. A second end of the first arm and a second end of the second arm can be pivotably coupled to the first gear and the second gear, respectively.

Entering the lateral wellbore from the main wellbore through the window with the lateral entry guide tool can include deactivating the positioning subassembly after the lateral entry guide tool passes through the window into the lateral wellbore.

Entering the lateral wellbore from the main wellbore through the window with the lateral entry guide tool can include, if the locator subassembly detects that the lateral entry guide tool is passing a bottom edge of the window while the positioning subassembly is activated, determining the lateral entry guide tool missed the window and remains in the main wellbore. After it is determined that the lateral entry guide tool missed the window and remains in the main wellbore, the work string is pulled back to position the lateral entry guide tool at the window entry depth. The work string is then run through the window while calibrating and adjusting the positioning subassembly as the work string passes through the window into the lateral wellbore.

Other implementations of the present disclosure for entering the lateral wellbore from the main wellbore through the window with the lateral entry guide tool includes include a control system (not shown). The control system can be positioned on the surface of the Earth. The control system can operably control the operations of the work string 202, the operations of the lateral entry guide tool 100, including the operations performed by the controller 146, and the operations of the downhole tool 104.

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A method of deploying a work string in a wellbore system comprising a main wellbore defining a window and a lateral wellbore extending from the window, the method comprising:

running a work string comprising a lateral entry guide tool through the wellbore system to a distance above the window;

activating a locator subassembly of the lateral entry guide tool, the locator subassembly configured to detect the window;

running the lateral entry guide tool through the main wellbore in a downhole direction from the distance above the window past the window;

after the locator subassembly indicates that the lateral entry guide tool is past the window, determining a window entry depth based on a depth at which the window was detected by the locator subassembly;

pulling the work string back to position the lateral entry guide tool at the window entry depth;

activating a positioning subassembly of the lateral entry guide tool after pulling the work string back; and simultaneously, running the work string through the window while calibrating and adjusting the positioning subassembly as the work string pass through the window into the lateral wellbore, wherein calibrating the positioning subassembly to position the work string to enter the window comprises:

collecting a distance from the tool to a top edge of the window, a distance from the tool to a bottom edge of the window, a distance from the tool to an inner surface of the main wellbore, and a distance from the tool to an inner surface of the lateral wellbore using the locator subassembly;

transmitting the distance from the tool to the top edge of the window, the distance from the tool to the bottom edge of the window, the distance from the tool to the inner surface of the main wellbore, and the distance from the tool to the inner surface of the lateral wellbore from the locator subassembly to a controller of the lateral entry guide tool; and generating with the distance from the tool to the top edge of the window, the distance from the tool to the bottom edge of the window, the distance from the tool to the inner surface of the main wellbore, the distance from the tool to the inner surface of the lateral wellbore, and a pre-programmed tool assembly characteristic using the controller:

an angle between a longitudinal axis of the lateral entry guide tool and the inner surface of the main wellbore, and a direction of the longitudinal axis of the tool.

2. The method of claim 1, wherein determining the window entry depth comprises collecting a depth of a top edge of the window and a depth of a bottom edge of the window using the locator subassembly.

3. The method of claim 2, wherein determining the window entry depth comprises comparing the depth of the top edge of the window and the depth of the bottom edge of the window.

4. The method of claim 1, wherein calibrating the positioning subassembly to position the work string to enter the window comprises:

operating a gear movement assembly of the positioning subassembly, the gear movement assembly configured to extend and retract to adjust the angle between the longitudinal axis of the lateral entry guide tool and the inner surface of the main wellbore; and rotating a rotatable housing of the positioning subassembly, the rotatable housing configured to adjust the direction of the longitudinal axis of the lateral entry guide tool, wherein adjusting the angle and the direction of the lateral entry guide tool positions the lateral entry guide tool to avoid colliding with the inner surface of the main wellbore and to enter the lateral wellbore from the main wellbore through the window.

5. The method of claim 4, wherein running the work string through the window while calibrating and adjusting the positioning subassembly as the work string pass through the window into the lateral wellbore comprises:

energizing a first motor and a second motor of the gear movement assembly to move a first gear and a second gear, respectively, along a rack from a respective first position to a respective second position;

wherein movement of the first gear and the second gear along the rack from a respective first position to a respective second position extends a first arm and a second arm laterally from other portions of the positioning subassembly.

6. The method of claim 5, wherein a first end of the first arm and a first end of the second arm are pivotably coupled by a pivot joint, and wherein a second end of the first arm and a second end of the second arm are pivotably coupled to the first gear and the second gear, respectively.

7. The method of claim 1, wherein the work string is a drill string.

8. The method of claim 1, further comprising deactivating the positioning subassembly after the lateral entry guide tool passes through the window into the lateral wellbore.

9. The method of claim 1, wherein the locator subassembly further comprises at least one of an acoustic sensor, an electromagnetic sensor, or an infrared sensor.

10. The method of claim 1, further comprising:

if the locator subassembly detects that the lateral entry guide tool is passing a bottom edge of the window while the positioning subassembly is activated, determining the lateral entry guide tool missed the window and remains in the main wellbore;

pulling the work string back to position the lateral entry guide tool at the window entry depth; and running the work string through the window while calibrating and adjusting the positioning subassembly as the work string passes through the window into the lateral wellbore.

11. A lateral entry guide tool for guiding a work string from a main wellbore through a window defined by the main wellbore into and a lateral wellbore extending from the window, the lateral entry guide tool comprising:

an uphole and a downhole connector configured to couple to other components of a work string;

a positioning subassembly comprising extendable arms configured to position the work string to enter the lateral wellbore through the window;

a locator subassembly attached to the positioning subassembly, the locator subassembly comprising:

a sensor operable to detect the window, wherein the sensor is further operable to detect a top edge of the window, a bottom edge of the window, a distance to an inner surface of the main wellbore, and a distance to an inner surface of the lateral wellbore; and a transmitter operable to send a signal indicating a presence of the window, wherein the transmitter is further operable to send a signal representing the top edge of the window, a signal representing the bottom edge of the window, a signal representing distance to the inner surface of the main wellbore, and a signal representing the distance to the inner surface of the lateral wellbore; and a controller operatively coupled to the positioning subassembly and the locator subassembly, the controller comprising:

a receiver in electronic communication with the locator subassembly;

a processor operable to generate, with the value of a depth of the window and a tool characteristic, a command signal to actuate the positioning subassembly; and wherein the controller:

receives, from the locator subassembly, the signal representing the value of the depth of the top edge of the window, the signal representing the value of the depth of the bottom edge of the window, the signal representing the value of the distance to the inner surface of the main wellbore, and the signal representing the value of the distance to the inner surface of the lateral wellbore;

calculates with the value of the distance to the top edge of the window, the value of the distance to the bottom edge of the window, the value of the distance to the inner surface of the main wellbore, the value of the distance to the inner surface of the lateral wellbore, and a pre-programmed lateral entry guide assembly characteristic:

an angle between a longitudinal axis of the tool and the inner surface of the main wellbore, and a direction of the longitudinal axis of the tool; and calibrates:

a gear movement assembly to extend and retract to adjust the angle between the longitudinal axis of the tool and the inner surface of the main wellbore, and a rotatable housing to adjust the direction of the longitudinal axis of the tool.

12. The tool of claim 11, wherein the positioning subassembly further comprises a gear movement assembly coupled to the extendable arms to actuate the extendable arms between a retracted position and an extended position.

13. The tool of claim 12, wherein actuating the extendable arms between the retracted position and the extended position adjusts an angle between a longitudinal axis of the tool and an inner surface of the main wellbore.

14. The tool of claim 11, wherein the positioning subassembly comprises a rotatable housing to adjust a direction of a longitudinal axis of the tool to avoid colliding with an inner surface of the main wellbore and to enter the lateral wellbore from the main wellbore through the window.

15. The tool of claim 12, wherein the gear movement assembly comprises:

a first arm;

a pivot joint coupled to a first end of the first arm;

a second arm, a first end of the second arm coupled to the pivot joint;

a first gear and a second gear, each gear pivotably coupled to a second end of the first arm and a second end of the first arm, respectively;

a geared rail, the geared rail positioned inside the tool, the first gear and the second gear movably coupled to the geared rail; and a first motor and a second motor operatively coupled to the first gear and the second gear, respectively, wherein the first motor and the second motor move the first gear and the second gear along the geared rail to extend and retract the first arm and the second arm by the pivot joint, and wherein the controller is further configured to operate the first motor and the second motor to move the first gear and the second gear along the geared rail to extend and retract the first arm and the second arm by the pivot joint.

16. The tool of claim 15, wherein the gear movement assembly is a first gear movement assembly, the tool further comprises a second gear movement assembly, wherein the first gear movement assembly and the second gear movement assembly each are positioned on an outer surface of the lateral entry guide tool, the first gear movement assembly and the second gear movement assembly positioned on opposite sides of the lateral entry guide tool.

17. The tool of claim 11, wherein the sensor comprises at least one of an ultrasonic sensor, a magnetic field sensor, or an infrared sensor.

* * * * *